US007291990B2

(12) United States Patent
Ichikawa et al.

(10) Patent No.: US 7,291,990 B2
(45) Date of Patent: Nov. 6, 2007

(54) DISCHARGE LAMP LIGHTING CIRCUIT

(75) Inventors: Tomoyuki Ichikawa, Shizuoka (JP); Takao Muramatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/484,804

(22) Filed: Jul. 10, 2006

(65) Prior Publication Data

US 2007/0007913 A1 Jan. 11, 2007

(30) Foreign Application Priority Data

Jul. 11, 2005 (JP) ..... P.2005-201444

(51) Int. Cl.
*H05B 41/36* (2006.01)

(52) U.S. Cl. ..... 315/291

(58) Field of Classification Search ..... 315/307, 315/291, 209 R, 157, 159, 246, 293
See application file for complete search history.

(56) References Cited

U.S. PATENT DOCUMENTS 4,700,113 A * 10/1987 Stupp et al. ..... 315/224
5,978,236 A * 11/1999 Faberman et al. ..... 363/37
6,504,316 B2 * 1/2003 Ito et al. ..... 315/224
6,791,279 B1 * 9/2004 Shearer et al. ..... 315/209 R
6,975,077 B2 * 12/2005 Izumi et al. ..... 315/209 R
7,023,143 B2 * 4/2006 Harada et al. ..... 315/209 R

FOREIGN PATENT DOCUMENTS

JP 7-142182 6/1995

* cited by examiner

*Primary Examiner*—Shih-Chao Chen
*Assistant Examiner*—Minh Dieu A
(74) *Attorney, Agent, or Firm*—Fish & Richardson P.C.

(57) ABSTRACT

A discharge lamp lighting circuit 1 is provided with a DC-AC conversion circuit 3 having a plurality of switching elements 5H, 5L and a series resonance circuit (8, 9, 7*p*), and control means 17 for preventing a situation in which the drive frequency of the switching element remains less than its specified minimum frequency. When the discharge lamp is lit, driving control of the switching element is carried out in a frequency range higher than the series resonance frequency. By using a driving situation detection circuit 15, a driving situation of the switching element is monitored based on a relation with a phase of a lamp current which flows through the discharge lamp. If the drive frequency of the switching element becomes less than the specified minimum frequency, the drive frequency is increased, and thereby, a lower limit of the drive frequency is automatically restricted.

10 Claims, 13 Drawing Sheets

DISCHARGE LAMP LIGHTING CIRCUIT

This application claims priority from Japanese application No. 2005-201444 filed on Jul. 11, 2005, the disclosure of which is incorporated herein in its entirety.

TECHNICAL FIELD

This disclosure relates to a discharge lamp lighting circuit of a resonance type high frequency lighting system, for example. In particular, the disclosure relates to a circuit in which the lighting frequency is set to 2 MHz or more to avoid an acoustic resonance band of a discharge lamp.

BACKGROUND ART

A lighting circuit of a discharge lamp, such as a metal halide lamp used as an automotive lighting source, includes a DC voltage increasing circuit having a DC-DC converter, a DC-AC conversion circuit (a so-called inverter), and a starting circuit. (See, e.g., Japanese patent document JP-A-7-142182.)

During lighting control of a discharge lamp, an unloaded output voltage (hereinafter referred to as "OCV".) is controlled before the discharge lamp is lit. The discharge lamp is lit by applying a starting signal through the use of a starting circuit. Thereafter, the lamp is shifted to a steady lighting situation by reducing transient electric power applied to the discharge lamp.

In the DC voltage boosting circuit, for example, a switching regulator with a transformer is used. In addition, a full bridge type configuration using multiple pairs of switching elements, is mentioned for use as the DC-AC conversion circuit.

In a configuration mode of carrying out 2-stage conversions (i.e., DC voltage conversion and DC-AC conversion), the circuit size becomes large, and is unsuitable for small size circuits or devices. As a result, other configurations have been suggested in which an output is supplied to a discharge lamp with the voltage boosted by 1-stage voltage conversion in a DC-AC conversion circuit.

For example, in an arrangement equipped with a series resonance circuit using a capacitor and an inductance element, it is possible to control the electric power applied to the discharge lamp by changing the operating frequency of a half-bridge (i.e., drive frequency of a switching element), which forms a DC-AC conversion circuit, based on the fact that impedance of the circuit changes depending on frequency.

Assuming that inductance, which is related to a series resonance circuit, is described as "L" and the electric capacitance of a resonance capacitor is described as "C," the resonance frequency "f0" is represented by "$f0=1/(2.\pi.\sqrt{(L.C)})$," and has a nearly symmetrical frequency characteristic with a central focus on f0. To obtain stable circuit operation, it is preferable to carry out electric power control by changing the drive frequency of a semiconductor switching element which forms the DC-AC conversion circuit in a frequency range higher than f0.

In a frequency range higher than the resonance frequency f0 (inductive domain or delayed phase domain), there is a tendency that, as applied electric power increases, there is a decrease of frequency. Therefore, it is possible to form a feedback control system by obtaining applied electric power (targeted through calculation), and changing the drive frequency of a switching element on the basis of variation of its result and actual output electric power.

To increase electric power applied to a discharge lamp when carrying out the foregoing feedback control in a higher frequency range than the resonance frequency at the time of turning on the discharge lamp, it is acceptable if the drive frequency is decreased. However, if the frequency becomes less than the resonance frequency, then when drive frequency is decreased, applied electric power falls off. In summary, in a frequency range lower than the resonance frequency f0 (capacitive domain or advanced phase domain), there is a tendency that applied electric power decreases with decrease of frequency and, therefore, when it is kept unchanged, fading-away occurs due to a decrease of applied electric power.

Circuit design of an electric power system including a DC-AC conversion circuit, a resonance circuit, a transformer is carried out so that sufficient electric power can be applied to a discharge lamp, in a frequency range at the resonance frequency or higher In the past, it has been difficult to define the drive frequency in the following situations.

- Situation where a power supply voltage to a lighting circuit decreases as a result, for example, of variation per hour or a change of surrounding environment, and it is not possible to output electric power at the targeted amount.
- Situation there it is desired to carry out electric power supply under closed loop control to apply electric power to a discharge lamp by maximum capacity of a lighting circuit for facilitating growth of a discharge lamp arc, immediately after a starting high voltage signal is applied to a discharge lamp and the discharge lamp is activated.

As the resonance frequency f0 is determined in dependence on "L.C" as described above, if the values of L and C are fixed, the value of f0 is also fixed and, therefore, it is acceptable if electric power control is not carried out in a frequency range less than f0, by placing a lower limit frequency so that the drive frequency does not become less than this value.

Resonance frequency is different with respect to each circuit, due to fluctuation of components which are used for the lighting circuit, and L value and C value change depending on the surrounding environment. Therefore, the value of the resonance frequency fluctuates.

To establish a minimum drive frequency for the lighting circuit in advance, it is possible to enlarge the margin error during design, or to adjust each circuit. However, in the former case, the circuit specification becomes excessive and cost increase. In addition, in the latter case, there is need to establish a lower limit frequency individually in mass production, which is not realistic.

The present invention addresses the situation where drive frequency becomes less than its minimum value, by automatically carrying out lower limit restriction of the drive frequency of a switching element, depending on a change of resonance frequency at the time of lighting-up, in a high frequency lighting circuit of a discharge lamp.

SUMMARY

In one aspect, the invention relates to a discharge lamp lighting circuit with a DC-AC conversion circuit having switching elements and a series resonance circuit, and control means for preventing continuation of a situation in which a drive frequency of the switching element becomes less than its minimum frequency. The circuit is arranges so that when the discharge lamp is lit, control is carried out so as to drive the switching element in a frequency range which is higher than the resonant frequency for the series resonance circuit. The driving situation of the switching element is monitored based on a relation with a phase of the lamp current which flows through the discharge lamp. If the drive frequency of the switching element becomes less than the minimum frequency, the drive frequency is increased.

According to an aspect of the present invention, the present invention is not configured to fixedly set up a minimum frequency value without considering a change of resonance frequency and a resonance situation with regard to a driving situation of a switching element. According to an aspect of the present invention, the driving situation of a switching element is monitored based on the relative phase with a lamp current which flows through the discharge lamp. Then, a lower limit of the frequency automatically is restricted to prevent continued decrease of the drive frequency, in case the drive frequency of the switching element becomes less than the minimum frequency.

According to the present invention, when a discharge lamp is lit, it is possible to prevent the drive frequency of a switching element from remaining below a minimum value, and it is effective for preventing fading-out of the discharge lamp. Furthermore, it is less likely that the circuit design specification will become excessive with significant cost increase. In addition, there is no need to adjust or change the setting of minimum frequency for individual devices, in view of production fluctuation and individual differences in circuit components.

It is preferable to set the minimum frequency at the resonance frequency which relates to the series resonance frequency or its neighboring frequency in a lighting situation of the discharge lamp. It is acceptable if the drive frequency is increased when the situation is detected by providing a driving situation detection circuit for detecting whether or not driving of the switching element is carried out in a frequency range lower than the resonance frequency or its neighboring frequency.

For example, in a mode of detecting a phase difference between any one of a signal for driving the switching element, an output of a DC-AC conversion circuit and a detection signal corresponding to a lamp voltage of the discharge lamp, and a detection signal which relates to a lamp current of a discharge lamp, it is possible to determine whether or not a switching element is driven in a frequency domain lower than the resonant frequency or its neighboring frequency, or to detect a level of deviation (deviation level) from a resonance with high accuracy, without coming under the influence of characteristic fluctuation of circuit components.

It is possible to increase the drive frequency by providing a circuit section for realizing polarity inversion (phase inversion) of a signal for driving a switching element, when it is detected that a switching element is driven in a frequency range lower than the minimum frequency (e.g., the resonance frequency). For example, it is possible to apply maximum electric power to a discharge lamp by regulating a switching element to a driving situation at a resonance point, in the event that the discharge lamp is about to be turned off.

Alternatively, it is acceptable to decrease a target value of electric power applied to the discharge lamp is decreased, depending on the amount of deviation from the minimum frequency, when it is detected that a switching element is driven in a frequency range less than the minimum frequency (e.g., higher neighboring value than resonance frequency)

To address situations when it is detected that a switching element is driven in a frequency range lower than the minimum drive frequency, it is preferable to provide a circuit section for increasing the drive frequency of the switching element in accordance with a predetermined time constant, to improve stability. (In sum, if drive frequency is increased suddenly at the detection point and then control for decreasing drive frequency is carried out after that, the following situation may occur: That is, if increase and decrease of drive frequency are repeated hours upon hours with sandwiching minimum frequency, there is such fear that a lighting operation becomes unstable or does harm to stability.).

Other features will be apparent from the following detailed description, the accompanying drawings and the claims.

BEST MODE FOR CARRYING OUT THE INVENTION

Figure 1:
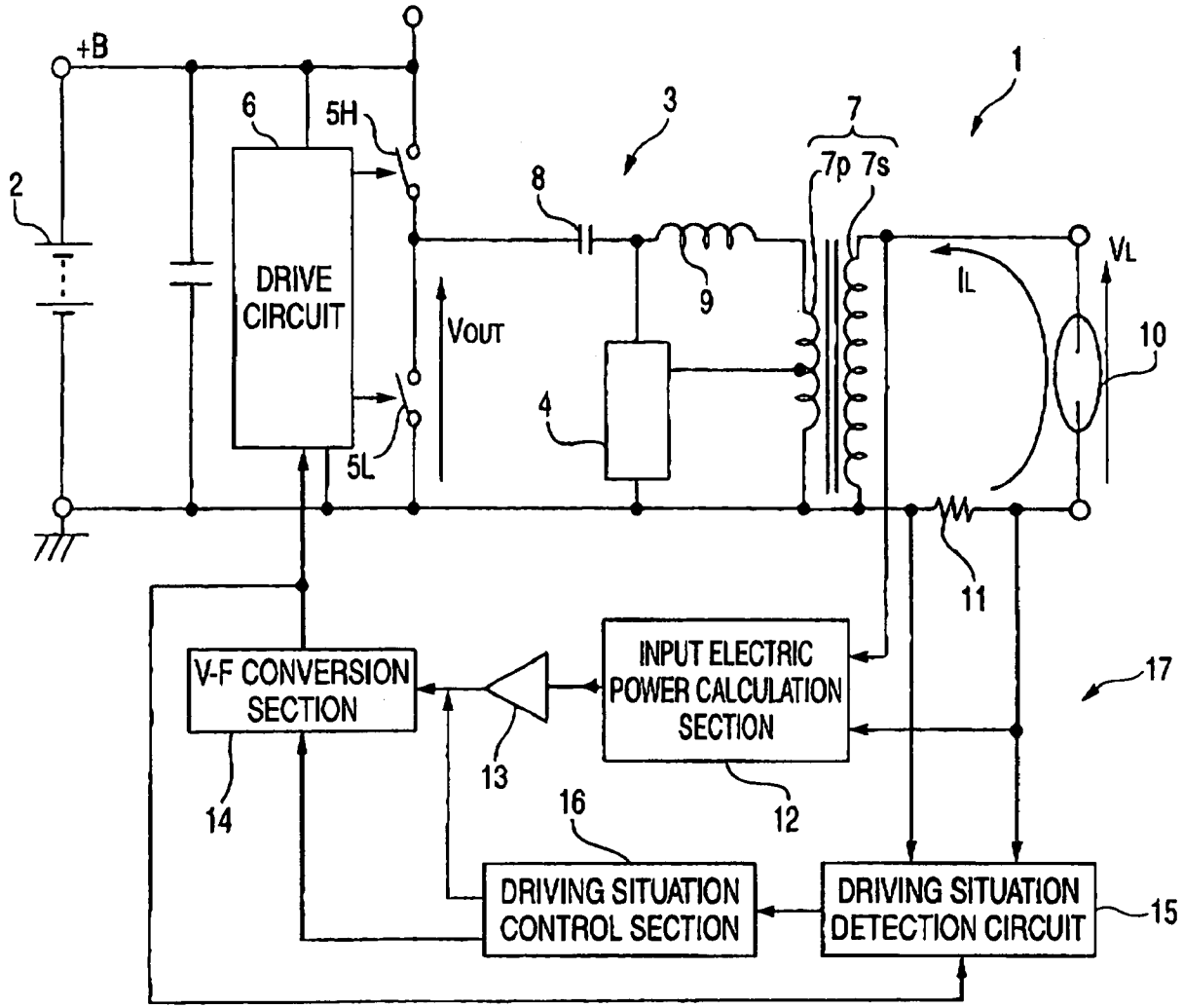
FIG. 1 shows a basic configuration example relating to the present invention.

FIG. 1 shows an example arrangement relating to the present invention. A discharge lamp lighting circuit 1 is equipped with a DC (direct current)-AC (alternate current) conversion circuit 3 which receives electric power supply from a DC power supply 2, and a starting circuit 4.

The DC-AC conversion circuit 3 is provided to perform AC conversion and voltage increasing in response to a DC input voltage (see "+B" of the figure) from the DC power supply 2. In this example, two switching elements 5H, 5L and a drive circuit 6 for driving them (e.g., a half-bridge driver) are provided. One end of the switching element 5H, which is located on a higher stage side among switching elements mutually connected in series, is connected to a power supply terminal, and the other end of the switching element is connected to ground through the switching element 5L, which is located on a lower stage side. Respective elements 5H, 5L are controlled so as to be turned ON/OFF one after the other by a signal from the drive circuit 6. For the purpose of simplification, the elements 5H, 5L are shown as signs for switches; however, the elements can be implemented, for example, as semiconductor switching elements such as a field effect transistor (FET) and a bipolar transistor.

The DC-AC conversion circuit 3 has a transformer 7 for use in electric power transmission and voltage increasing. In this example, in its primary side, the circuit arrangement uses resonance of a resonance capacitor 8, an inductor or an inductance component. At least the following three types of configuration modes are possible.

(I) A first mode utilizing resonance of the resonance capacitor 8 and an inductance element (II) A second mode utilizing resonance of the resonance capacitor 8 and leakage inductance of the transformer 7

(III) A third mode utilizing the resonance capacitor 8, an inductance element, and leakage inductance of the transformer 7

In the first mode (I), an inductance element 9, such as a resonance coil is provided. One end of the element is connected to the resonance capacitor 8, and the capacitor 8 is connected to a connection point of the switching elements 5H and 5L. The other end of the inductance element 9 is connected to a primary winding 7*p* of the transformer 7.

In the second mode (II), the addition of a resonance coil is unnecessary by utilizing an inductance component of the transformer 7. It is acceptable for one end of the resonance capacitor 8 to be connected to the connection point of the switching elements 5H and 5L, and the other end of the capacitor 8 to be connected to the primary winding 7*p* of the transformer 7.

In the third mode (III), it is possible to use series composite reactance of the inductance element 9 and leakage inductance.

In any of the modes, the switching elements are turned ON/OFF one after the other by utilizing series resonance of the resonance capacitor 8 and an inductive element (inductance component and inductance element) and by setting the drive frequency of the switching elements 5H, 5L to the value of the series resonance frequency or higher. A discharge lamp 10 (e.g., metal halide lamp used in an automotive lamp component), which is connected to a secondary wiring 7*s* of the transformer 7, is lit. During drive control of each switching element, there is need to drive respective elements in an alternating fashion, so that both switching elements are not in an ON situation (depending on-duty control). In addition, as to series resonance frequency, if resonance frequency after power-on, but before the lamp is lit is referred to as "Foff," resonance frequency in a lighting situation is referred to as "Fon," electric capacitance of the resonance capacitor 8 is referred to as "Cr," inductance of the inductance element 9 is referred to as "Lr," and primary side inductance of the transformer 7 is referred to as "Lp", for example, in the above-mentioned mode (III), then at the time before lighting of the discharge lamp after power-on, "$Foff=1/(2.\pi.\sqrt{(Cr.(Lr+Lp))})$.". For example, when the drive frequency is lower than Foff, loss of the switching element becomes large and efficiency worsens. Therefore, a switching operation in a frequency range higher than Foff is carried out. In addition, at the time after lighting of the discharge lamp, "$Fon\approx1/(2.\pi.\sqrt{(Cr.Lr)})$" ($Foff<Fon$). In this case, a switching operation is carried out in a frequency range higher than Fon.

It is preferable that, at the time after power-on of the lighting circuit, OCV is controlled by a frequency value adjacent to Foff in a fade-away situation of the discharge lamp (unloaded situation). In the event that it is shifted to a lighting situation after activation of the discharge lamp by a starting signal, lighting control in a frequency range higher than Fon is carried out.

The starting circuit 4 is for supplying a starting signal to the discharge lamp 10. An output voltage of the starting circuit 4 is boosted by the transformer 7 at the time of starting and then it is applied to the discharge lamp 10. (A starting signal is overlapped with an output which was converted into AC, and then, it is supplied to the discharge lamp 10.) This example shows a mode in which one of the output terminals of the starting circuit 4 is connected to mid-flow of the primary winding 7*p* of the transformer 7, and the other output terminal is connected to one end (ground side terminal) of the primary winding 7*p*. Examples of inputs to the starting circuit 4 include a mode of obtaining an input voltage to the starting circuit from a secondary or starting winding of the transformer 7, and a mode of obtaining an input voltage to the starting circuit from a winding which is disposed as an auxiliary winding which configures the transformer together with the inductance element 9.

FIG. 1 illustrates a circuit mode of carrying out conversion from a DC input into AC, and voltage-increasing in the DC-AC conversion circuit 3 to carry out electric power control of a discharge lamp. In case of detecting a lamp voltage to be applied to the discharge lamp 10, for example, a method of dividing an output voltage of the transformer 7 or a method of adding a detection winding and a detection terminal to the transformer 7 to carry out detection, are cited.

In addition, in case of detecting a lamp current which flows through the discharge lamp 10, for example, a method of carrying out voltage conversion by disposing a current detection resistor 11 on a secondary side of the transformer 7 is cited. Without limiting the particular arrangement, it is acceptable an arrangement in which an auxiliary winding, which forms the transformer, is disposed together with the inductance element 9, and a current, which is comparable to a current flowing through the discharge lamp 10, is detected.

A detection signal of a voltage and a current relating to the discharge lamp 10 is sent to an applied electric power calculation section 12. A value of electric power to be applied to the discharge lamp 10 is calculated, and a control signal based on a calculation result is sent to a voltage-frequency conversion section (hereinafter, described as "V-F conversion section".) 14 through an error amplifier 13.

The V-F conversion section 14 generates a signal having a frequency which changes depending on its input voltage (pulse frequency modulated signal), and sends the signal to the drive circuit 6. In this way, the drive frequency of signals applied from the drive circuit 6 to control terminals of the switching elements 5H, 5L is controlled.

A driving situation detection circuit 15 detects whether or not the drive frequency of the switching element is less than the minimum frequency based on a detection signal of a lamp current due to the current detection resistor 11, and a rectangular wave shaped drive signal which is sent out to the drive circuit 6. For example, the circuit 15 detects whether or not driving of a switching element is carried out at or near the resonant frequency.

A detection signal by the driving situation detection circuit 15 is sent to a driving situation control section 16 at a subsequent stage. If a situation is detected where the drive frequency of the switching element becomes less than the minimum frequency, control is carried out so that the drive frequency is increased, or electric power applied to the discharge lamp decreases.

An output signal of the driving situation control section 16 is sent to the V-F conversion section 14, or utilized for changing an output of the error amplifier 13. Thus, in the event it is detected that the driving of the switching element is carried out in a frequency range lower than the minimum frequency, for example, the following control modes are provided.

(A) Mode of operating a signal which is sent from the V-F conversion section to the drive circuit 6

(B) Mode of operating a control target (or control instruction value) of applied electric power in a previous stage of the V-F conversion section 14.

In the above-mentioned mode (A), for example, by reversing polarity of a rectangular wave shaped drive signal supplied to the switching element and increasing drive frequency, control is carried out so that the drive frequency of the element does not remain less than the minimum frequency (lower limit).

In addition, in the above-mentioned mode (B), by decreasing a target value of electric power applied to a discharge lamp, depending on the deviation amount from the minimum frequency (e g., the resonance frequency or higher),—i.e., a decreasing amount so that the current drive frequency becomes less than the minimum frequency—restriction is carried out so that the drive frequency of the element does not remain less than the minimum frequency.

A specific circuit configuration and its operation in each mode will be described in detail below.

The example of FIG. 1 includes the applied electric power calculation section 12, the error amplifier 13, the V-F conversion section 14, the drive circuit 6, the driving situation detection circuit 15, and the driving situation control section 16 serves as control means 17. By that means, the drive frequency of the switching elements 5H, 5L is controlled and its minimum frequency is guaranteed.

Next, control of OCV and electric power in the lighting circuit will be explained.

Figure 2:
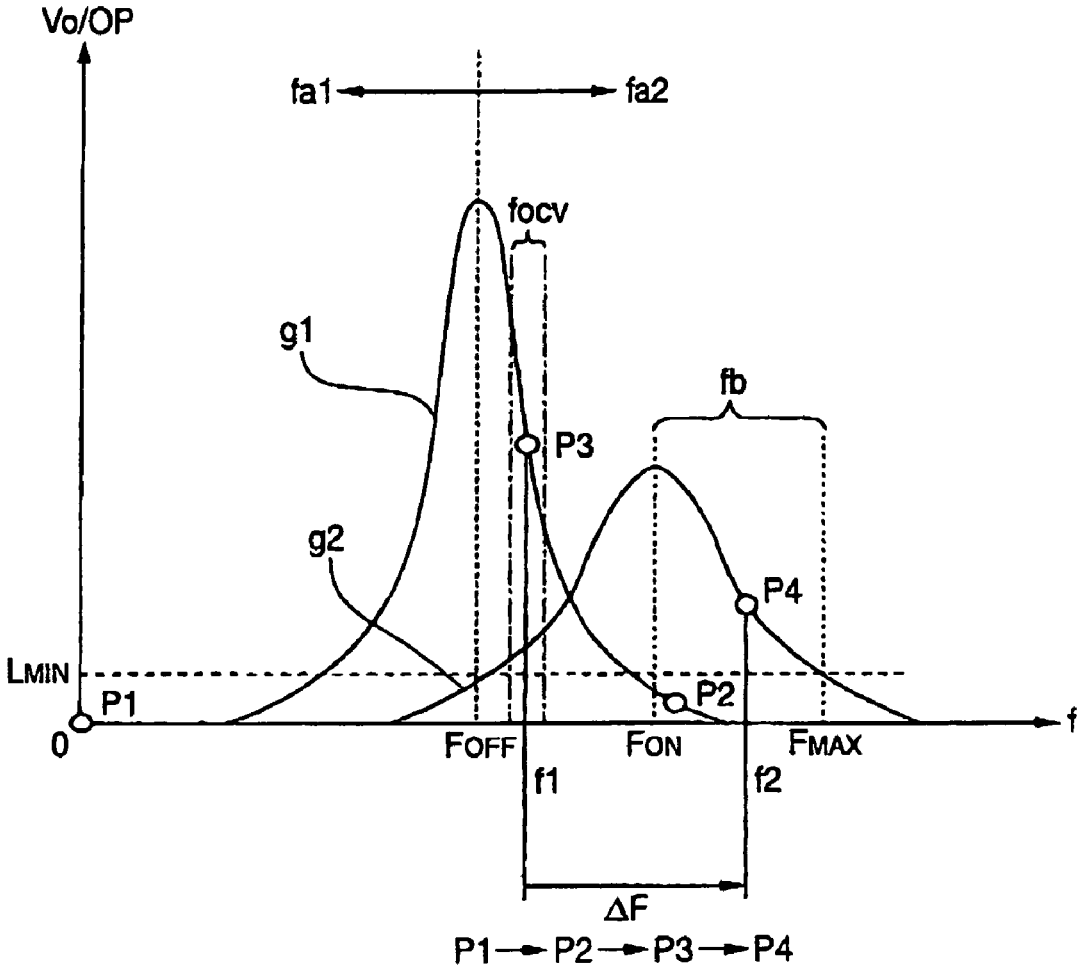
FIG. 2 is a schematic graph view for explaining a frequency characteristic relating to LC series resonance.

FIG. 2 is a schematic graph view for explaining a frequency characteristic when utilizing LC series resonance, and drive frequency "f" is shown on the horizontal axis, and an output voltage "Vo" or an output voltage "OP" of the lighting circuit is shown on the vertical axis. The figure illustrates a resonance curved line "g1" at the time of fade-away of the discharge lamp and a resonance curved line "g2" at the time of lighting-up.

As to the resonance curved line "g1," the vertical axis shows the output voltage "Vo." As to the resonance curved line "g2," a vertical axis shows the output voltage "OP".

At the time of fade-away of the discharge lamp, a secondary side of the transformer 7 is of high impedance, and an inductance value on a primary side of the transformer is high, and a resonance curved line g1 of resonance frequency Foff is obtained. In addition, at the time of lighting-up of the discharge lamp, impedance of a secondary side of the transformer 7 is low (approximately several Ω through several hundred Ω), and an inductance value of a primary side becomes low, and a resonance curved line g2 of resonance frequency Fon is obtained. (At the time of lighting-up, the amount of change in the voltage is relatively small. In contrast, the current changes significantly.)

The meaning of each sign shown in the figure is as described below.

"fa1"=frequency domain of "f<Foff" (capacitive domain or advanced phase domain which is located on a left side of "f=Foff")

"fa2"=frequency domain of "f>Foff" (inductive domain or delayed phase domain which is located on a right side of "f=Foff")

"fb"=frequency domain which is located at "f>Fon" (which is a frequency domain at the time of lighting-up, and is within an inductive domain on a right side of "f=Fon")

"focv"=control scope of an output voltage at the time before lighting (at the time of fade-away). (Hereinafter, this is referred to as "OCV control scope." This is located in the vicinity of Foff within fa2.)

"Lmin"=output level enabling to keep lighting of a discharge lamp

"P1"=operating point at the time before power-on

"P2"=initial operating point at the time immediately after power-on

"P3"=operating point which shows an arrival time point to a target value of OCV at the time of fade-away (in focv)

"P4"=operating point at the time after lighting (in domain fb)

"f1"=drive frequency of a switching element at immediately before lighting-up of a discharge lamp (e.g., drive frequency at the operating point P3)

"f2"=drive frequency of a switching element at the time of lighting-up of a discharge lamp (e.g., drive frequency at the operating point P4)

"Fmax"=frequency at an intersection point of g2 and Lmin (permissible upper limit frequency)

The flow of lighting transition control relating to a discharge lamp is as follows.

(1) A circuit power supply is turned on (P1→P2)

(2) OCV value is heightened in OCV control scope focv (P2→P3)

(3) A starting pulse is generated and it is applied to a discharge lamp (P3)

(4) After the discharge lamp starts lighting, a value of lighting frequency (drive frequency of a switching element) is fixed for a given period of time (hereinafter, referred to as "frequency fixing period".) (P3)

(5) It is shifted to electric power control in fb (P3→P4)

At the time immediately after power-on and at the time immediately after a discharge lamp is once turned on and then, turned off, drive frequency is heightened temporarily (P1→P2), and frequency is decreased gradually to approximately f1 (P2→P3)

Control of OCV is carried out in focv, and a starting signal to a discharge lamp is generated. The discharge lamp is turned on by application of the signal. For example, when the frequency is decreased and approximated from a high frequency side to resonance frequency Foff, in control of OCV, the output voltage Vo is becoming large little by little, and arrives at a target vale at the operating point P3. Meanwhile, in a method of carrying out control of OCV in the domain fa1 at the time of fade-away before the discharge lamp is turned on, switching loss becomes quite large and circuit efficiency becomes worse. In addition, in a method of carrying out control of OCV in the domain fa2, attention is needed so as for a period in which a circuit is operated continuously at the time of no load to become longer beyond necessity.

At the operating point P3, when the discharge lamp is started by the starting circuit 4, the drive frequency is set to a constant value during a frequency fixed period. Thereafter, the drive frequency is shifted to the domain fb (see "ΔF" in the figure). Meanwhile, in frequency transition from the OCV control scope focv to the domain fb, it is preferable to continuously change the frequency from f1 to f2 after the discharge lamp has started lighting.

As described above, in such a configuration that, at the time of fade-away of a discharge lamp, output voltage control in the frequency domain fa2 which is higher than resonance frequency Foff, is carried out. At the time of lighting-up the discharge lamp, electric power control is carried out in the frequency domain fb which is higher than the resonance frequency Fon (in an inductive domain, electric power becomes stable easily, by a depressant effect to current fluctuation.). If a situation is detected such that the drive frequency decreases too much and becomes less than the minimum frequency, control is carried out such that the drive frequency is decreased, or electric power applied to a discharge lamp decreases.

Next, driving situation detection of a switching element will be explained.

Figure 3:
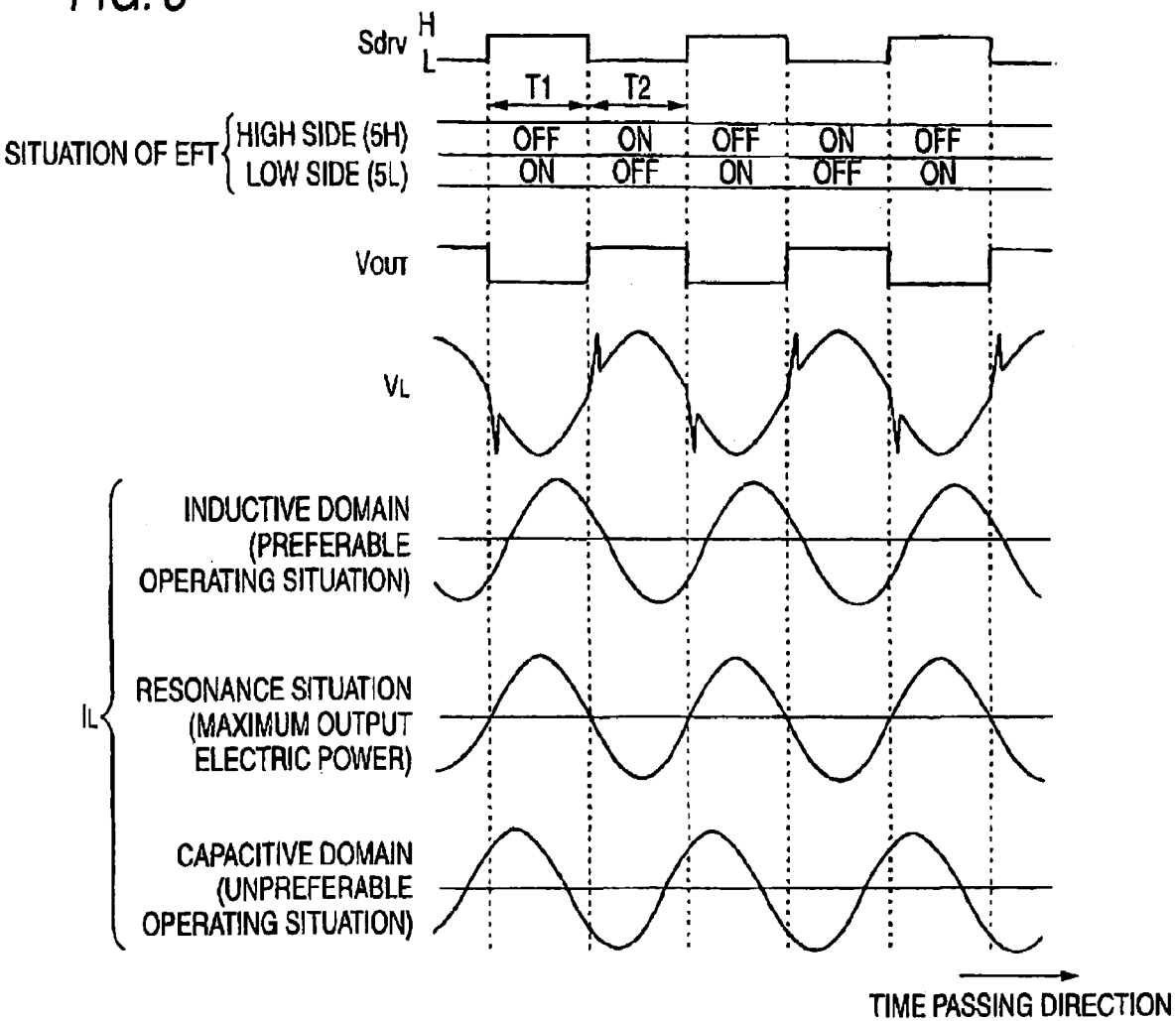
FIG. 3 is a view for explaining about driving situation detection of a switching element.

FIG. 3 shows a temporal change about a drive signal relating to a switching element (bridge drive signal) "Sdrv", ON/OFF situations of each switching element 5H, 5L, a half bridge output voltage "Vout" of the DC-AC conversion circuit 3 shown in FIG. 1, lamp voltage wave form "VL" and lamp current wave form "IL," and it represents these phase relations. The directions of each voltage and current are defined by respective arrow directions shown in FIG. 1.

The signal Sdrv is set as a rectangular wave (or square wave) shaped signal which is controlled by a signal that is sent from the V-F conversion section 14 to the drive circuit 6.In this example, during a period when Sdrv is in a H(high) level, the high side switching element 5H is turned OFF, and the low side switching element 5L is turned ON, and both elements are in an inverted phase relation.

The output voltage "Vout" is in an inverted phase relation to the signal Sdrv. In addition, a re-firing voltage at the time of polarity changeover of Vout, which is in nearly the same phase relation with Vout, is overlapped with the lamp voltage wave form "VL", and becomes a distorted sine wave.

As to the lamp current wave form "IL," an upper stand shows a case in which the drive frequency of a switching element is higher than the resonance frequency Fon (driving situation in an inductive domain), and a middle stand shows a resonance situation, i.e., in which the drive frequency is equivalent to the resonance frequency (maximum electric power output situation), and a lower stand shows a case in which the drive frequency is lower than the resonance frequency Fon (driving situation in a capacitive region).

During a period "T1" shown in the figure, the switching element 5H is turned OFF, and the switching element 5L is turned ON, and in a resonance situation, a lamp current of a sine wave is realized. By using the situation as a benchmark, a delayed wave form is realized in the inductive domain, and an advanced wave form is realized in the capacitive domain. In addition, during a period "T2" shown in the figure, the switching element 5H is turned ON, and 5L is turned OFF, and in a resonance situation, a lamp current of a negative half wave is realized.

In the event that the drive frequency becomes lower than the resonance frequency, i.e., since drive control in the capacitive domain is not desirable, in the event that the situation is detected, it becomes necessary to return to drive control in the inductive domain by increasing drive frequency so that this situation will not continue.

Conditions for determining occurrence of a situation when drive frequency has become lower than the resonance frequency are as follows.

(α1) In a driving situation during the period "T1", AND (logical product) is taken about the following two conditions.

(α1-1) A lamp current shows a positive value at a rising time point of Sdrv.

(α1-2) There is such timing that the lamp current shows a negative value if Sdrv is in the H(high) level.

(α2) In a driving situation during the period "T2," AND (logical product) is taken about the following two conditions.

(α2-1) A lamp current shows a negative value at a rising time point of Sdrv.

(α2-2) There is such timing that the lamp current shows a positive value in case that Sdrv is in the L(low) level.

In a situation where the above-mentioned conditions (α1) or (α2) are not satisfied, an operation in the capacitive domain is carried out. That is, a final judgment condition, representing an OR operation (logical sum) of the above-mentioned conditions (α1) and (α2), is performed. If the final judgment condition indicates a true value, then a driving situation in the capacitive domain is detected.

Figure 4:
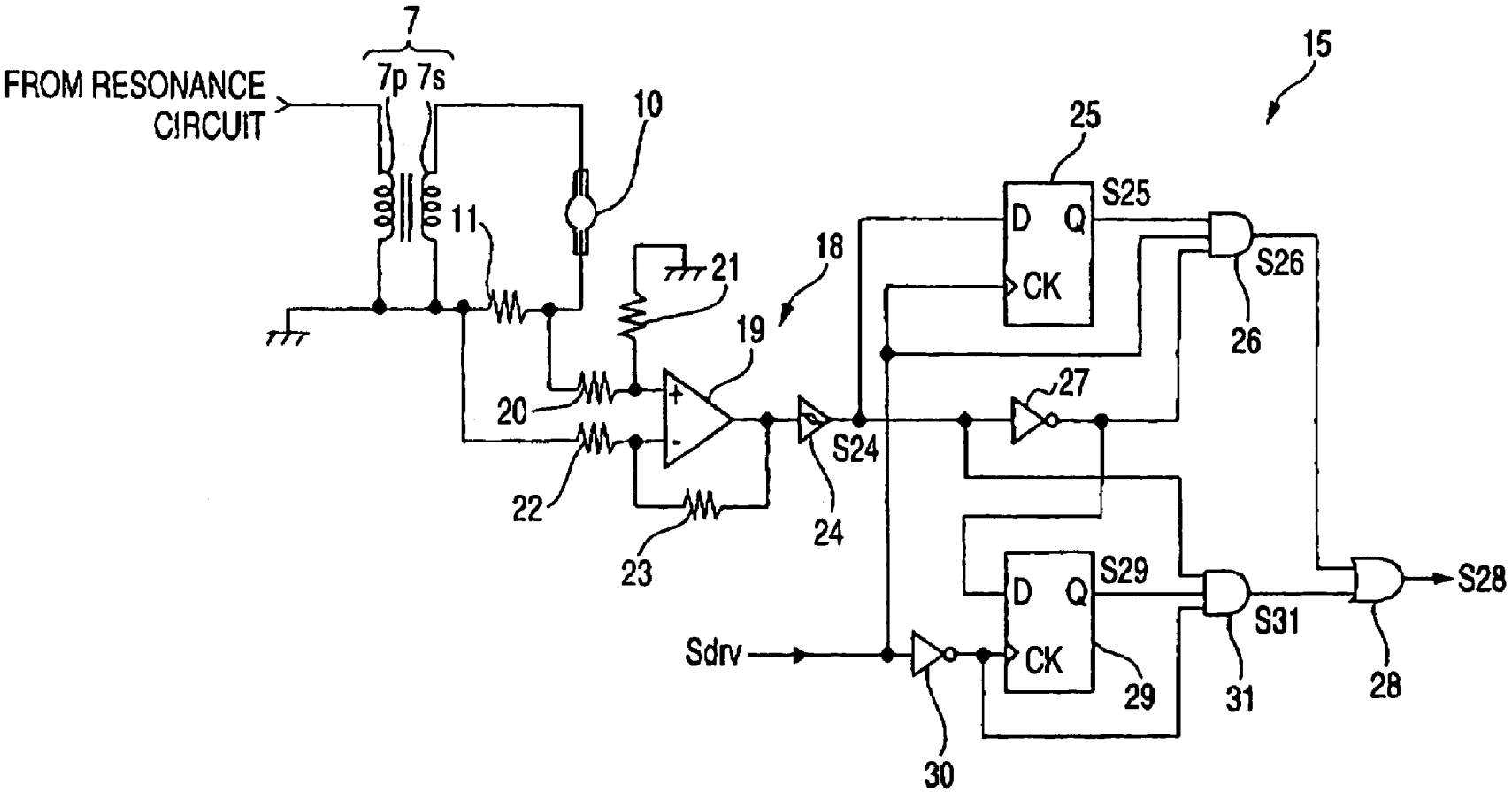
FIG. 4 shows a configuration example of a driving situation detection circuit.

FIG. 4 shows a configuration example of the driving situation detection circuit 15. In this example, a phase difference between a signal for driving a switching element, and a detection signal of a lamp current of a discharge lamp is detected. A determination is made as to whether or not the switching element is driven in a frequency range less than the resonance frequency, and the amount of deviation (deviation level) from the resonance situation is detected.

A detection signal of a lamp current, which is obtained by the current detection resistor 11, is sent to a differential amplification circuit 18.

The differential amplifier 18 can be implemented, for example, with an operational amplifier 19, whose non-inverting input terminal is connected to one end of the current detection resistor 11 (terminal on the side of the discharge lamp 10) through a resistor 20, and is connected to ground through a resistor 21. An inverting input terminal of the operational amplifier 19 is connected to the other end of the current detection resistor 11 through a resistor 22. A feedback resistor 23 is located between the inverting input terminal and an output terminal.

An output signal of the operational amplifier 19 is sent to a hysteresis comparator 24 at a subsequent stage.

An output signal of the hysteresis comparator 24 is supplied to the D terminal of D-type flip-flop 25. In addition, the signal Sdrv is supplied to its clock signal input terminal (CK). Then, the Q output of the flip-flop 25 is sent to a 3 input AND gate 26 at a subsequent stage.

The signal Sdrv and a signal from the hysteresis comparator 24 through a NOT (logical negation) gate 27 are provided as inputs to an AND gate 26, in addition to the output signal of D flip-flop 25. An output signal showing a result of logical product calculation of these 3 signals is sent to an OR gate 28 at a subsequent stage.

An output signal of the NOT gate 27 is supplied to the D terminal of D-type flip-flop 29. In addition, the signal Sdrv is supplied to its clock signal input terminal (CK) through a NOT gate 30. Then, its Q output is supplied to a 3 input AND gate 31 at a subsequent stage.

An output signal of the NOT gate 30 and an output signal of the hysteresis comparator 24 are provided as inputs to the AND gate 31, in addition to an output signal of the D flip-flop 29. An output signal showing a result of logical product calculation of these 3 signals is sent to the OR gate 28 at a subsequent stage.

The two-input OR gate 28 provides an output signal indicating an OR (logical sum) calculation result of each output signal of the AND gate 26, 31. The signal is a final driving situation detection signal.

When there is a voltage drop, an electric current flowing through the current detection resistor 11 is detected and is amplified by the operational amplifier 19. In the hysteresis comparator 24 at a subsequent stage, a determination is made as to whether or not a lamp current is flowing, by the result of a comparison with a predetermined threshold value. A binary signal, which corresponds to a judgment result, is provided as an output from the comparator 24. (At the time of detection of a positive current, an H level signal is provided as output; at the time of detection of a negative current, an L level signal is provided as output.)

When the signal Sdrv has risen from the L level to the H level, an output signal level of the hysteresis comparator 24 is latched by the D flip-flop 25. If the Q output signal of the flip-flop 25 is in the H level (see the above-mentioned condition (α1-1)), and an output signal of the hysteresis comparator 24 is in L level when the signal Sdrv is in H level (see the above-mentioned condition (α1-2)), an H level signal is provided as an output from the AND gate 26. (Thus, driving of the switching element is carried out in a frequency range less than the resonance frequency during the period T1 of FIG. 3.)

In addition, when the signal Sdrv has fallen from the H level to the L level, an output signal level of the NOT gate 27 is latched by the D flip-flop 29. If the Q output signal of the flip-flop 29 is in H level (see the above-mentioned condition (α2-1)), and an output signal of the hysteresis comparator 24 is in the H level when the signal Sdrv is in L level (see the above-mentioned condition (α2-2)), then an H level signal is provided as output from the AND gate 31. (Thus, driving of a switching element is carried out in a frequency range less than the resonance frequency during the period T2 of FIG. 3.)

Figure 5:
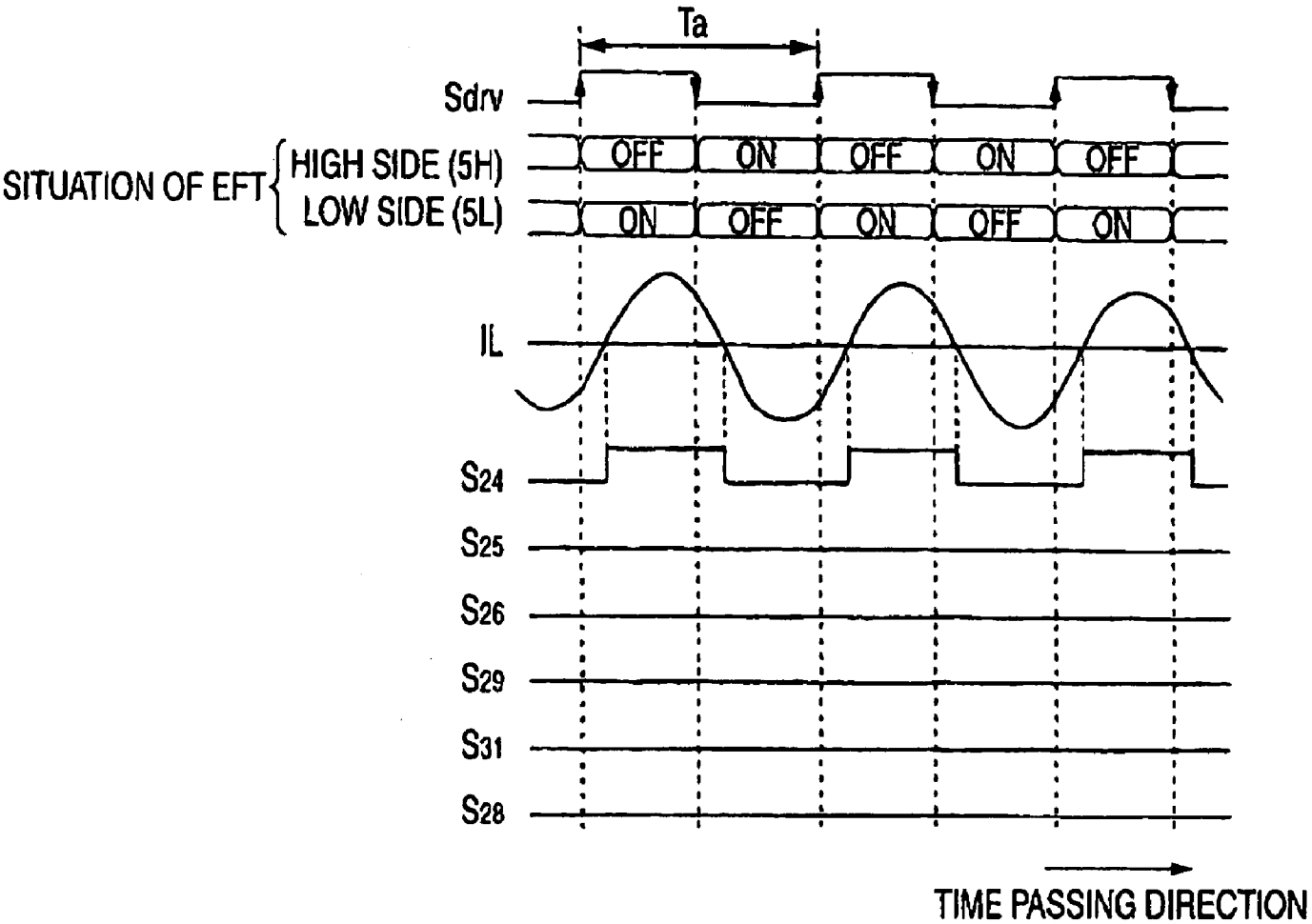
FIG. 5 is a timing chart for explaining circuit operation of FIG. 4, together with FIGS. 6 and 7; this figure shows an operating situation in a frequency range higher than the resonance frequency.
Figure 6:
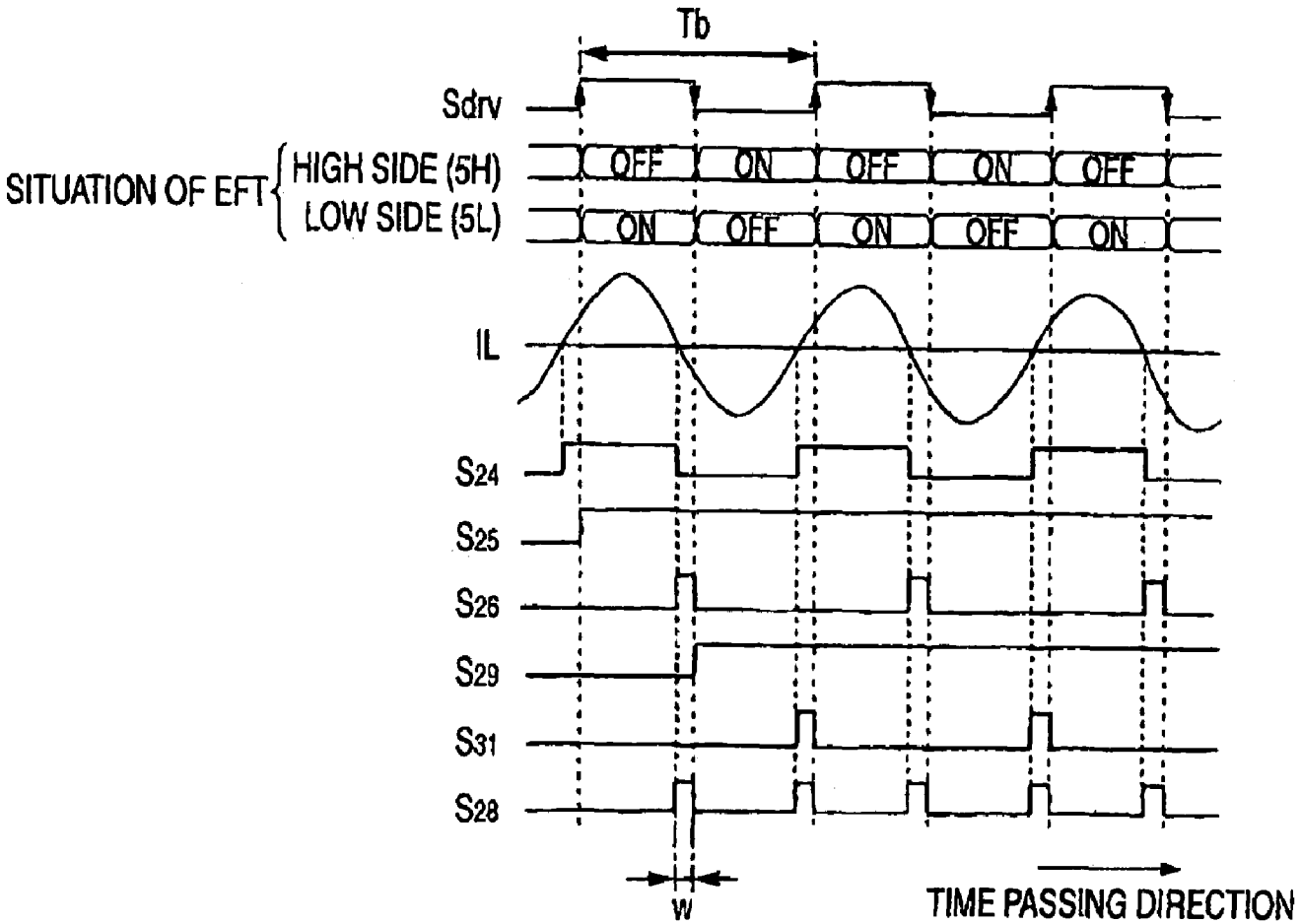
FIG. 6 shows an operating situation at a short time after it enters into a frequency range lower than the resonance frequency.
Figure 7:
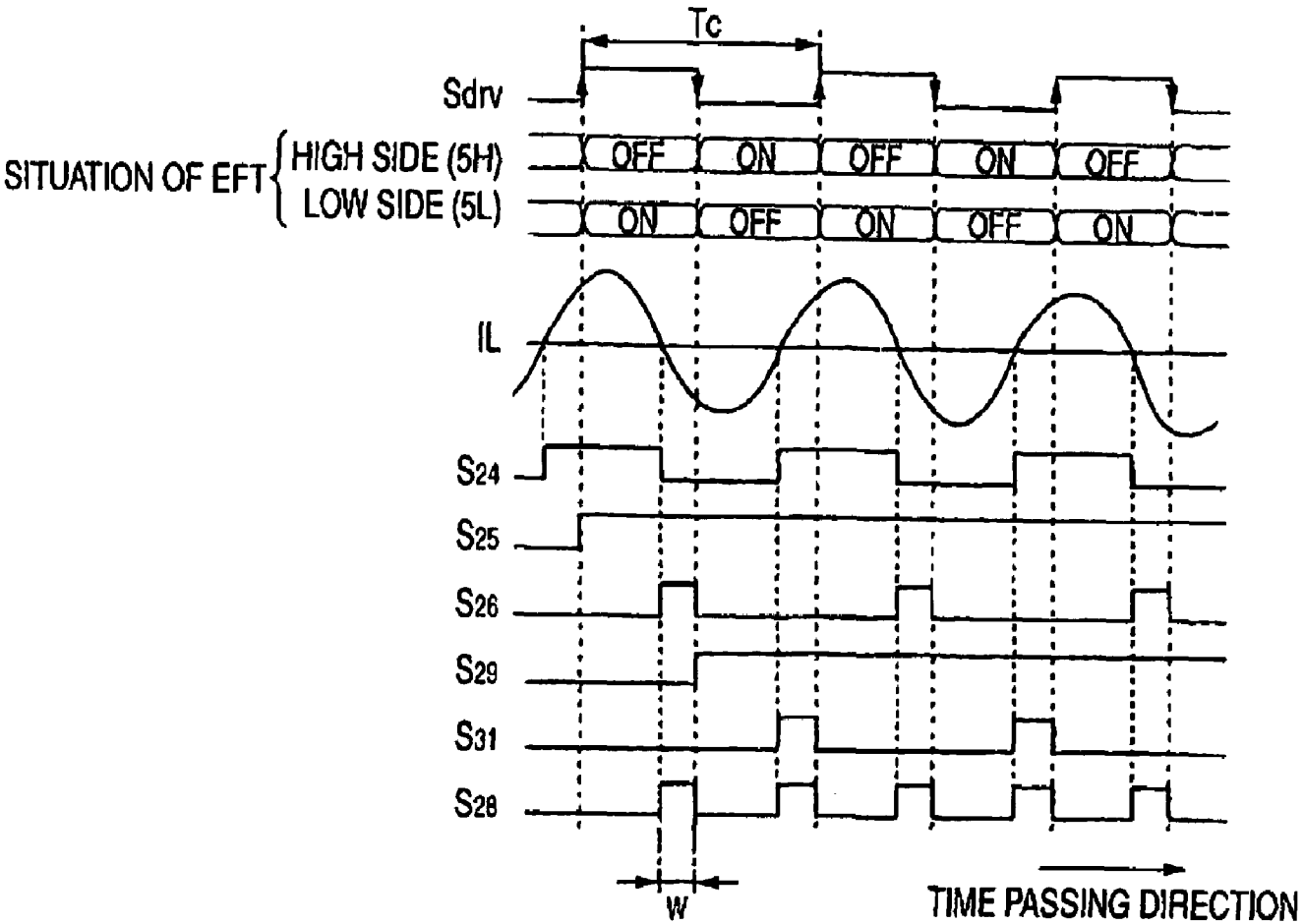
FIG. 7 shows an operating situation in case of further tapping into a frequency range lower than the resonance frequency, in comparison with FIG. 6.

FIGS. 5 through 7 are timing charts which show an operational example of the above-mentioned circuit. The meaning of each sign in the figure is as follows.

"S24"=output signal of the hysteresis comparator 24
"S25"=Q output signal of the D flip-flop 25
"S26"=output signal of the AND gate 26
"S29"=Q output signal of the D flip-flop 29
"S31"=output signal of the AND gate 31
"S28"=output signal of the OR gate 28
Sdrv and IL are as described above.

FIG. 5 illustrates an operating situation in an inductive domain where the drive frequency of the switching element is higher than the resonance frequency (Fon). "Ta" in the signal Sdrv indicates a cycle.

The signal S24 is at an H level during a positive period of the lamp current IL, and is at an L level during a negative period of the lamp current IL.

The signal S25 is at the L level after it takes in the signal S24 at a rising time point of the signal Sdrv.

The signal S29 is at the L level after it takes in a logical negation signal of the signal S24 at a rising time point of the signal Sdrv.

Therefore, any of the signals S26, S31, and S28 becomes an L level signal. That is, an output signal of the driving situation detection circuit 15 (driving situation detection signal) is at an L level in the inductive domain.

FIG. 6 illustrates an operating situation shortly after entering a capacitive domain in which the drive frequency of the switching element is lower than the resonance frequency (Fon).

As to the signal Sdrv, its cycle "Tb" has become longer than the above-mentioned "Ta".

The signal S25 is at the H level after it takes in the signal S24 at a rising time point of the signal Sdrv.

The signal S26 is a logical product signal of the signal S25, a logical negation signal of the signal S24, and Sdrv, and is a pulse-shaped signal synchronized with a falling time point of S24.

In addition, the signal S29 is at the H level after it takes in a logical negation signal of the signal S24 at a rising time point of the signal Sdrv.

The signal 31 is a logical product signal of the signal 529, the signal S24, and a logical negation signal of the signal Sdrv, and is a pulse-shaped signal synchronized with a rising time point of S24.

The signal S28 is a logical sum signal of the signal S26 and the signal S31, and represents an output signal of the driving situation detection circuit 15 (driving situation detection signal) in the capacitive domain. In the figure, "w" represents the pulse width.

FIG. 7 illustrates an operating situation in which the drive frequency becomes much lower as compared to the situation of FIG. 6 and goes too deeply in the capacitive domain.

Differences from FIG. 6 are indicated below.

A cycle "Tc" of the signal Sdrv is longer than the above-mentioned "Tb".

Phase deviation of a lamp current has become larger (deviation amount in an advanced phase direction is large to Sdrv).

Pulse widths of the signals S26, S31 and S28 are large.

The phase relation of each signal is as explained in FIG. 6. However, as it is in a driving situation that the drive frequency becomes much lower and goes too deeply into the capacitive domain, a pulse width of the signal S28 becomes large. In sum, in the capacitive domain, an output signal of the driving situation detection circuit 15 (driving situation detection signal) includes information which shows a level of entry into the capacitive domain (or capacitive strength) as a size of a pulse width (see "w") (The stronger the capacitive property becomes, the larger the pulse width becomes.)

This example shows a configuration mode which does not generate time delay by carrying out detection of driving situations during the periods T1 and T2 of FIG. 3 through use of the above-mentioned conditions (α1) and (α2), respectively. Even a detection mode which uses only one of the above-mentioned conditions (α1) and (α2), as needed, may be acceptable in some situations.

The driving situation detection circuit shown in this example is configured to detect whether or not driving of a switching element is carried out in a lower frequency domain than resonance frequency Fon, and obtain a pulse-shaped signal if the driving of the switching element is carried out in the lower frequency domain than resonance frequency Fon. However, the present invention is not limited to this. The driving situation detection circuit may be configured to detect whether or not a driving situation of a switching element is in a lower situation than minimum frequency which is set on a high frequency side in the vicinity of Fon, and carry out the control of electric power in a direction of increasing drive frequency of a switching element or of decreasing electric power applied to a discharge lamp if the driving situation of the switching element is in the lower situation than minimum frequency which is set on the high frequency side in the vicinity of Fon.

For example, it is possible to delay a phase of the signal Sdrv or S24 shown in FIGS. 5 through 7, by a delay circuit. In sum, it is possible to establish a minimum frequency within the inductive domain which is close to the resonance frequency by intentionally delaying a phase of the signal Sdrv. In addition, it is possible to establish a minimum frequency within the capacitive domain which is close to the resonance frequency by intentionally delaying a phase of the signal S24. If the delay circuit has a CR integration circuit using a resistor and a capacitor and a Schmitt trigger circuit at its subsequent stage, the delay can be established according to the time constant determined by the resistance value and electric capacitance of the capacitor. The wave form of an integration output is shaped by the Schmitt trigger circuit. In the configuration shown in FIG. 4, the signal Sdrv is sent through the delay circuit to the flip-flop 25, the AND gate 26, and the NOT gate 30, so that it is possible to provide the desired phase delay to the signal. Alternatively, is the circuit can be configured so that the delay circuit is inserted into a subsequent stage of the hysteresis comparator 24 and its output signal is sent out to the flip-flop 25, the NOT gate 27, and the AND gate 31. In that case, it also is possible to provide the desired phase delay to the signal S24.

In application of the present invention, it is possible to carry out various modes such as a mode in which, in lieu of the signal Sdrv for driving the switching element, a signal having a synchronized relation with Sdrv is used. An example is a detection signal relating to an output voltage of the DC-AC conversion circuit and a detection signal of a lamp voltage of a discharge lamp.

Next, the driving situation control section 16 is explained.

Figure 8:
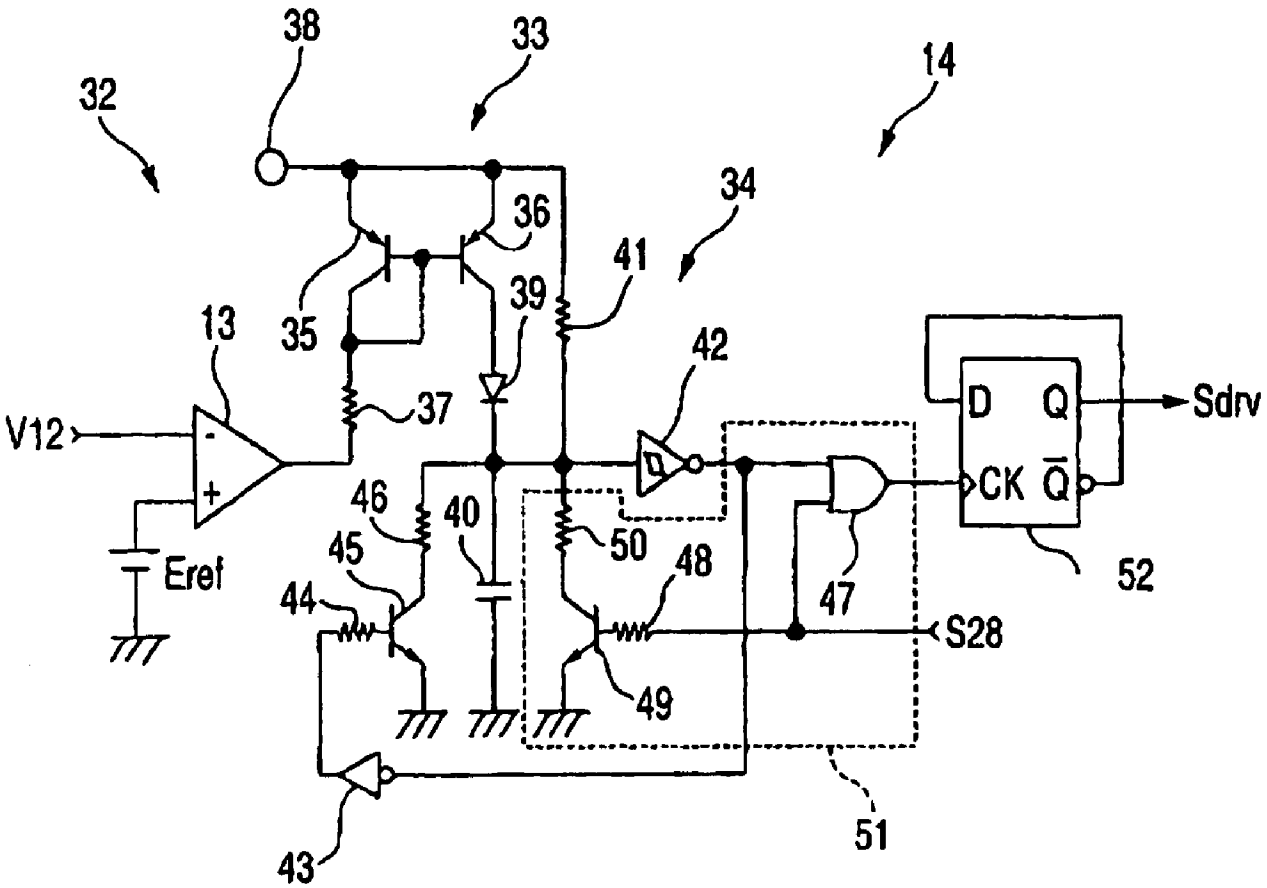
FIG. 8 shows a circuit configuration example relating to a driving situation control section.

FIG. 8 shows a substantial part of one example 32 of a circuit configuration relating to the above-mentioned mode (A). The figure shows a configuration mode in which polarity of a bridge driving signal Sdrv is inverted if the drive frequency of the switching element decreases and has entered into the capacitive domain.

In the error amplifier 13, a control voltage from the applied electric power calculation section 12 (hereinafter, referred to as "V12") is supplied to its negative side input terminal. In addition, a reference voltage "Eref" (indicated by a constant voltage source sign) is supplied to its positive side input terminal. In sum, when a level of V12 is high (low), an output of the error amplifier 13 decreases (increases). An output signal of the amplifier is sent to the V-F conversion section 14 at a subsequent stage.

The applied electric power calculation section 12 has a circuit configuration for carrying out control of electric power which is applied in a time of transition after a discharge lamp started lighting, control of electric power in a stable steady state, and so on. An output value of the applied electric power calculation section 12 is comparable to a target value and an instruction value of electric power applied to a discharge lamp (e.g., in a driving situation in an inductive domain, in case that an output value is small, an electric power value to be applied is large.). However, in application of the present invention, a configuration relating to the applied electric power calculation section 12 is not limited.

The V-F conversion section 14 is, in this example, provided with a control characteristic such that the output frequency decreases (increases) according to an increase (decrease) of its input voltage, and is equipped with a current source 33 using a current mirror, and a ramp wave generation section 34.

Emitters of FNP transistors 35, 36, which form a current mirror, are connected to a power supply terminal 38, and the bases are connected to each other. A collector of the transistor 35 is connected to a base of the transistor, and is connected to an output terminal of the error amplifier 13 through a resistor 37.

The collector of the transistor 36 is connected to an anode of a diode 39, and a cathode of the diode is connected to ground through a capacitor 40.

A tone end of resistor 41 is connected to the power supply terminal 38, and the other end is connected to the capacitor 40.

One end (non-grounded side terminal) of the capacitor 40 is connected to an input terminal of the hysteresis comparator 42, and an output signal of the comparator 42 is supplied to a base of a transistor 45 through a NOT gate 43 and a resistor 44, and is provided an input to an OR gate 47.

The emitter of the NPN transistor 45 is connected to ground, and its collector is connected between the diode 39 and the capacitor 40 through the resistor 46.

A two-input OR gate 47 forms a circuit section 51 for driving situation control (additional circuit to the ramp wave generation section 34), together with a resistor 48, a transistor 49, and a resistor 50. The circuit section 51 is for inverting a phase of a rectangular wave-shaped signal used for driving the switching element, in the event the switching element is driven in a frequency range lower than the minimum frequency (in this example, the resonance frequency). In this example, a detection signal from the driving situation detection circuit 15 (driving situation detection signal S28) is supplied to one input terminal of the 2 input OR gate 47, and supplied to a base of the transistor 49 through the resistor 48.

The emitter of the NPN transistor 49 is connected to ground, and its collector is connected to an input terminal of the hysteresis comparator 42 through a resistor 50.

A logical sum signal of an output signal of the hysteresis comparator 42 and a detection signal from the driving situation detection circuit 15 is supplied from the OR gate 47 to a clock signal input terminal (CK) of a D flip-flop 52.

The D terminal of the D flip-flop 52 is connected to a Q-bar terminal, and serves as a T(toggle) type configuration Q output signal is sent to the above-described drive circuit 6 as the signal Sdrv.

Figure 9:
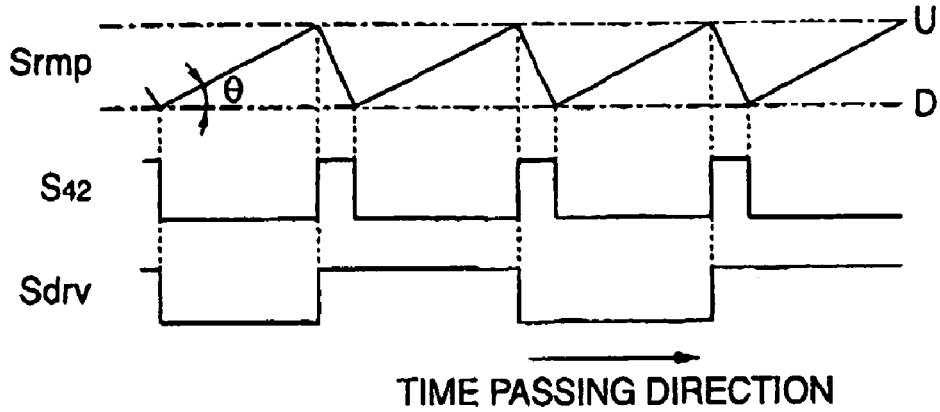
FIG. 9 is an operation explanatory view of a case of assuming that the circuit section 51 does not exists in FIG. 8.

FIG. 9 illustrates a wave form of each section for a situation in which the circuit section 51 is not present in the configuration of FIG. 8 (i.e., an output signal of the hysteresis comparator 42 is supplied to a clock signal input terminal of the D flip-flop 52). The meaning of each sign is as described below.

"Srmp"=electric potential at a connection point of the diode 39 and the capacitor 40 (it shows a PFM ramp wave. "PFM"=pulse frequency modulation.)

"S42"=output signal of the hysteresis comparator 42 Signal Sdrv is a Q output of the D flip-flop 52.

In this example, a current, which corresponds to an output of the error amplifier 13, is returned through the transistors 35, 36, and the capacitor 40 is charged with inclination (which is time change rate; see an angle "η" of the figure) of electric potential which corresponds to the output (here, the higher the output voltage level of the error amplifier 13, the lower the charge currency of the capacitor 40) Then, a terminal voltage of the capacitor is compared to a predetermined threshold value (see the upper limit threshold value "U" shown in the figure) in the hysteresis comparator 42. In sum, electric potential of the capacitor 40 increases, and when it reaches the threshold value, the transistor 45 is turned ON.

By this means, discharge of the capacitor 40 is started, and a terminal voltage of the capacitor is compared to a predetermined threshold value (see the lower limit threshold value "D" shown in the figure) in the hysteresis comparator 42. In sum, electric potential of the capacitor 40 decreases, and when it reaches the threshold value, the transistor 45 is turned OFF, and charging of the capacitor 40 is started again.

In this way, a charging operation of the capacitor 40 and a discharging operation of the capacitor 40 are repeated, and thereby, as Srmp, a ramp wave (PFM ramp wave) corresponding to an output of the error amplifier 13, is obtained. Then, this passes through the D flip-flop 52, and becomes a rectangular wave-shaped signal (PFM output signal) with a duty cycle of 50%.

Depending on an output of the error amplifier 13, a charging current of the capacitor 40 is determined, and variable control of frequency (PFM frequency) is carried out so that inclination of the ramp wave changes. In sum, as output of the error amplifier 13 decreases (increases), a charging current increases (decreases) and frequency becomes higher (lower).

Figure 10:
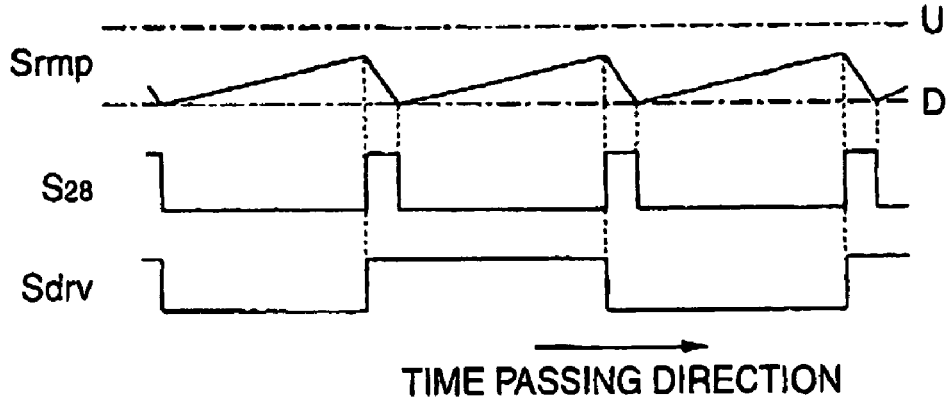
FIG. 10 is an operation explanatory view of a case considers the presence of circuit section 51 in FIG. 8.

FIG. 10 illustrates a wave form of each section for a situation including the circuit section 51. The wave form shows the above-mentioned Srmp, S28 and Sdrv signals.

In this example, inclination showing an electric potential change of Srmp is slow, and the frequency is low, thus indicating a driving situation in the capacitive domain.

When the driving situation detection signal S28 is provided as an input to the circuit section 51, and is at a H level, the transistor 49 is turned ON even if the level of Srmp does not reach the upper limit threshold value of the hysteresis comparator 42, and the capacitor 40 is discharged. As a result, a lower limit restriction on the frequency works automatically as the frequency of the ramp wave becomes high. Meanwhile, S28 passes through the OR gate 47 and is sent to the D flip-flop 52; the polarity of sdrv is inverted.

In this way, the circuit section 51 provides a lower limit restriction on the frequency, depending on the drive situation detection signal S28.

Next, a circuit configuration example 53 relating to the above-mentioned mode (B) will be explained.

Figure 11:
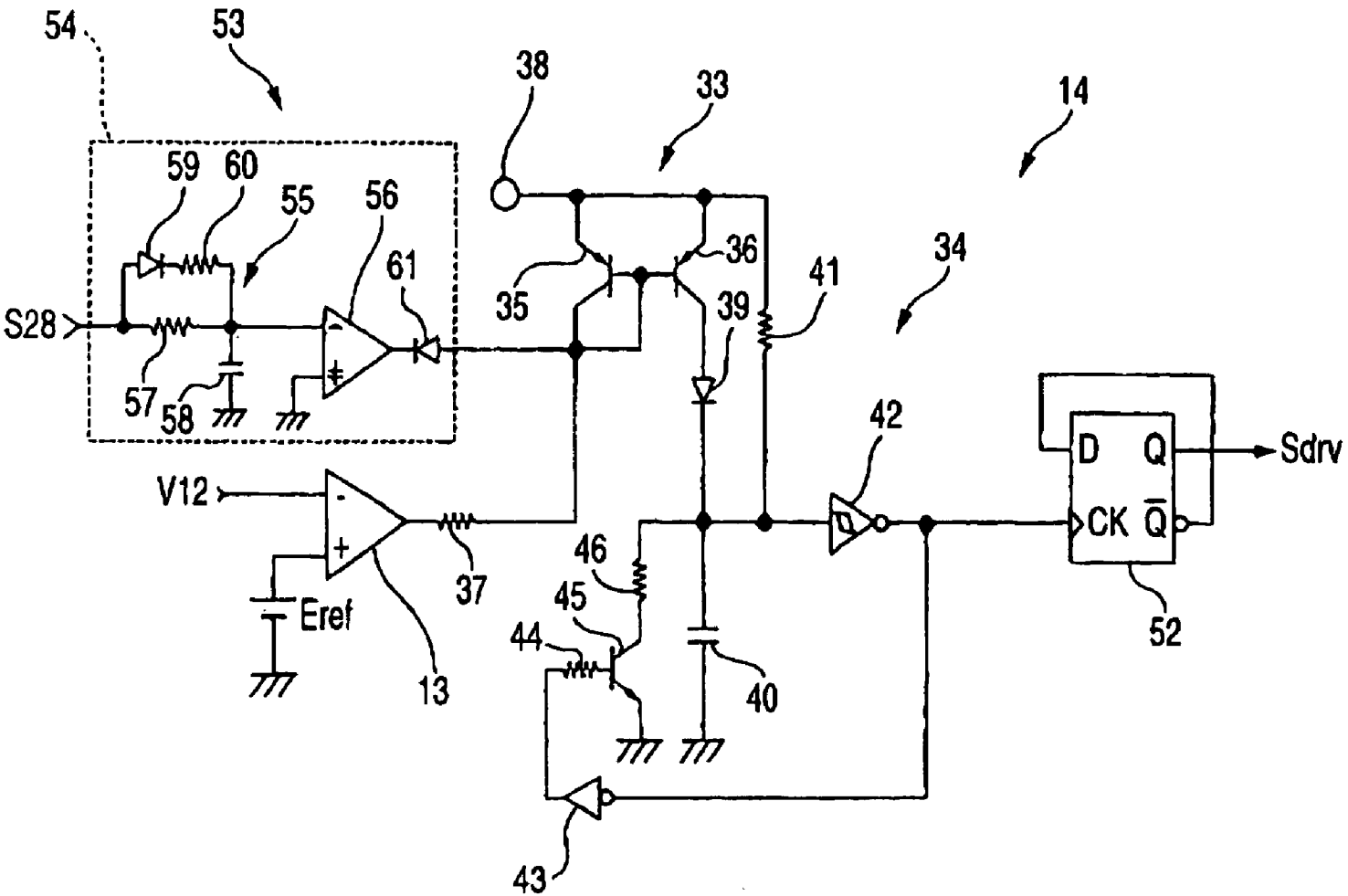
FIG. 11 shows another example about a circuit configuration relating to a driving situation control section.

FIG. 11 shows a substantial part of the circuit configuration such that a control target of applied electric power is decreased, depending on the amount of deviation from the resonance situation when the driving frequency of the switching element reaches the minimum frequency or less.

Differences from the configuration example shown in FIG. 8 are as shown below.

- The circuit section 51 is not present in the ramp wave generation section 34.
- A circuit section 54, which is connected to the error amplifier 13 in parallel, is provided.

The circuit section 54, to which the driving situation detection signal S28 is provided, is for driving situation control relating to a switching element, and for decreasing a target value of electric power applied to a discharge lamp, depending on the amount or deviation from the minimum frequency, in the event it is determined that a switching element is driven in a frequency range lower than the minimum frequency. In this example, the circuit section 54 has a low pass filter 55 and an amplifier 56.

The low pass filter 55 is composed of an integration circuit including a resistor 57 and a capacitor 58, and a series circuit of a diode 59 and a resistor 60. An anode of the diode 59 is connected to one end of the resistor 57, and a cathode of the diode is connected to a connection point of the resistor 57 and the capacitor 58 through the resistor 60.

For example, an operational amplifier is used as the amplifier 56, and its inverting input terminal is connected to one end (non-grounded side terminal) of the capacitor 58, and a non-inverting input terminal of the operational amplifier is connected to ground. An output terminal of the amplifier 56 is connected to a cathode of a diode 61, and an anode of the diode is connected to a collector of the transistor 35.

As described above, a pulse width of the driving situation detection signal S28 represents the amount of deviation from the resonance situation (i.e., capacitive strength), and in this example, when the detection signal is provided to the circuit section 54, it passes through the low pass filter 55, and becomes a dull wave form. An output voltage of the low pass filter 55 reflects the amount of deviation from the resonance situation to the capacitive domain, and a voltage signal of that capacitor 58 is amplified by the amplifier 56. Thereafter, it is added to a reference side of the current source 33 relating to generation of a PFM ramp wave through the diode 61 (it is connected as a current sink type).

By increasing an output voltage of the low pass filter 55, a charging current from the current source 33 to the capacitor 40 increases, and thereby, the frequency of a PEM ramp wave becomes high, and the drive frequency exits from the capacitive domain. In sum, the greater the deviation from the resonance situation, the more increasing frequency works, and thereby, a lower limit restriction on the drive frequency is realized.

Meanwhile, in this example, the resistor 37 is disposed between the error amplifier 13 and the current source 33, but it is configured in such a manner that the frequency lower limit restriction by the circuit section 54 works on a preferential basis, by disposing no resistor between the circuit section 54 and the current source 33 or inserting a resistor having a sufficiently smaller resistance value than the resistor 37.

Next, a circuit configuration is explained to increase the drive frequency little by little by use of predetermined time constant in the event the driving situation detection circuit 15 detects that the drive frequency of the switching element decreases and is shifted from the resonance situation to the capacitive domain.

Figure 12:
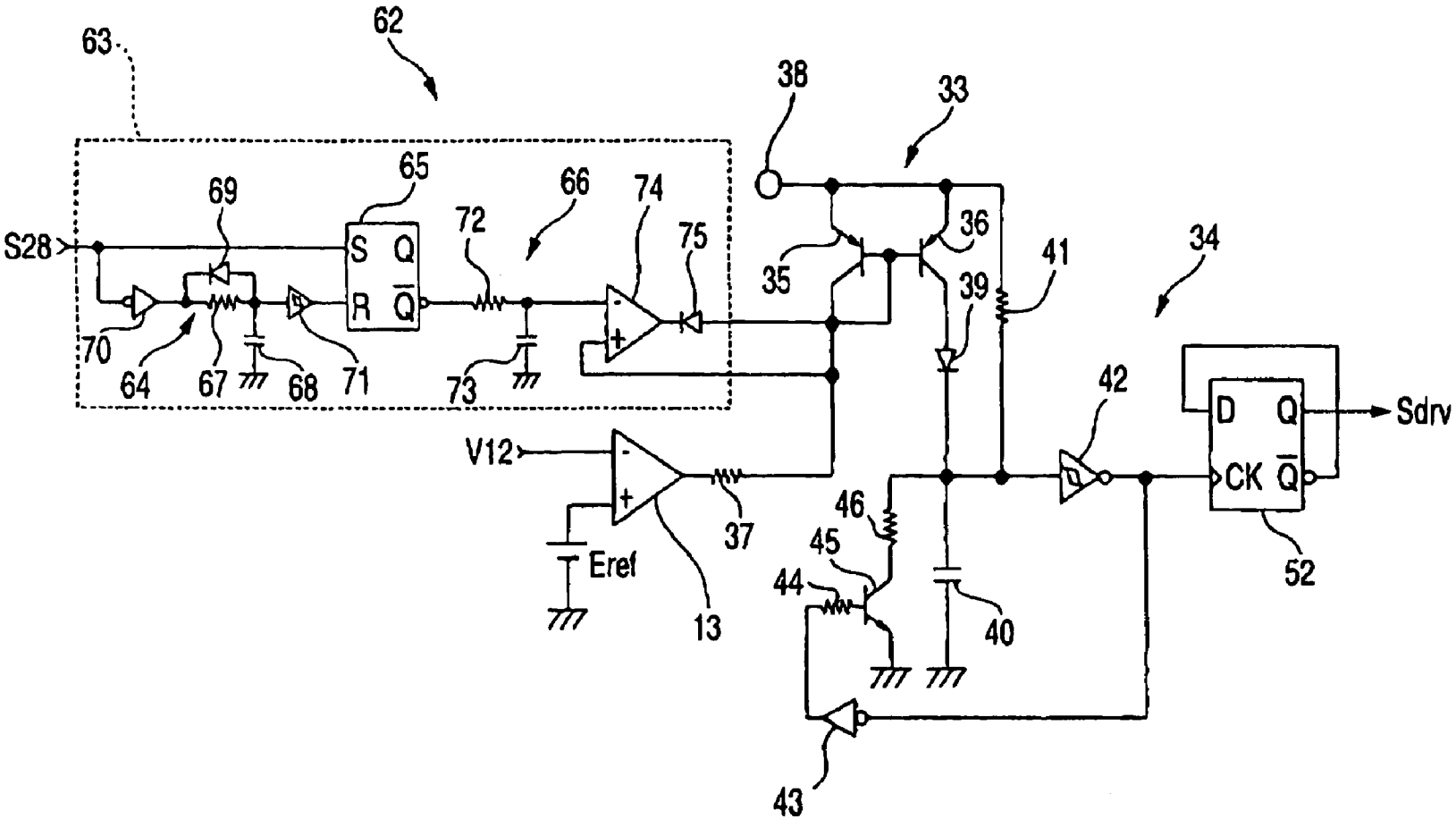
FIG. 12 shows still another example about a circuit configuration relating to the driving situation control section.

FIG. 12 shows a substantial part of a circuit configuration 62. In a circuit section 63 shown by a broken line frame, it differs from the configuration shown in FIG. 11.

The circuit section 63, to which the driving situation detection signal S28 is provided, is for driving situation control relating to a switching element. The circuit section 63 has a first low pass filter 64, a RS flip-flop 65, and a second low pass filter 66.

The first low pass filter 64 is disposed as a delay circuit for guaranteeing operational stability, and has an integration circuit including a resistor 67 and a capacitor 68, and a diode 69 connected to the resistor 67 in parallel. To the anode of the diode is connected between the resistor 67 and the capacitor 68.

The driving situation detection signal S28 is sent to a set (S) terminal of the RS flip-flop 65, and sent to the low pass filter 64 through a NOT gate 70. An output signal of the low pass filter 64 is sent to a reset (R) terminal of the RS flip-flop 65 through a Schmitt trigger circuit 71.

Q-bar output of the RS flip-flop 65 is provided to a buffer amplifier 74, through a second low pass filter 66 disposed at a subsequent stage, i.e., an integration circuit composed of a resistor 72 and a capacitor 73. This second low pass filter 66 determines the time constant in case of changing drive frequency.

The buffer amplifier 74 can be implemented, for example, by an operational amplifier, and an output of the low pass filter 66 is supplied to its non-inverting input terminal. Its output terminal is connected to a cathode of a diode 75, and an anode of the diode is connected to an inverting input terminal of the operational amplifier, and connected to a collector of the transistor 35.

Figure 13:
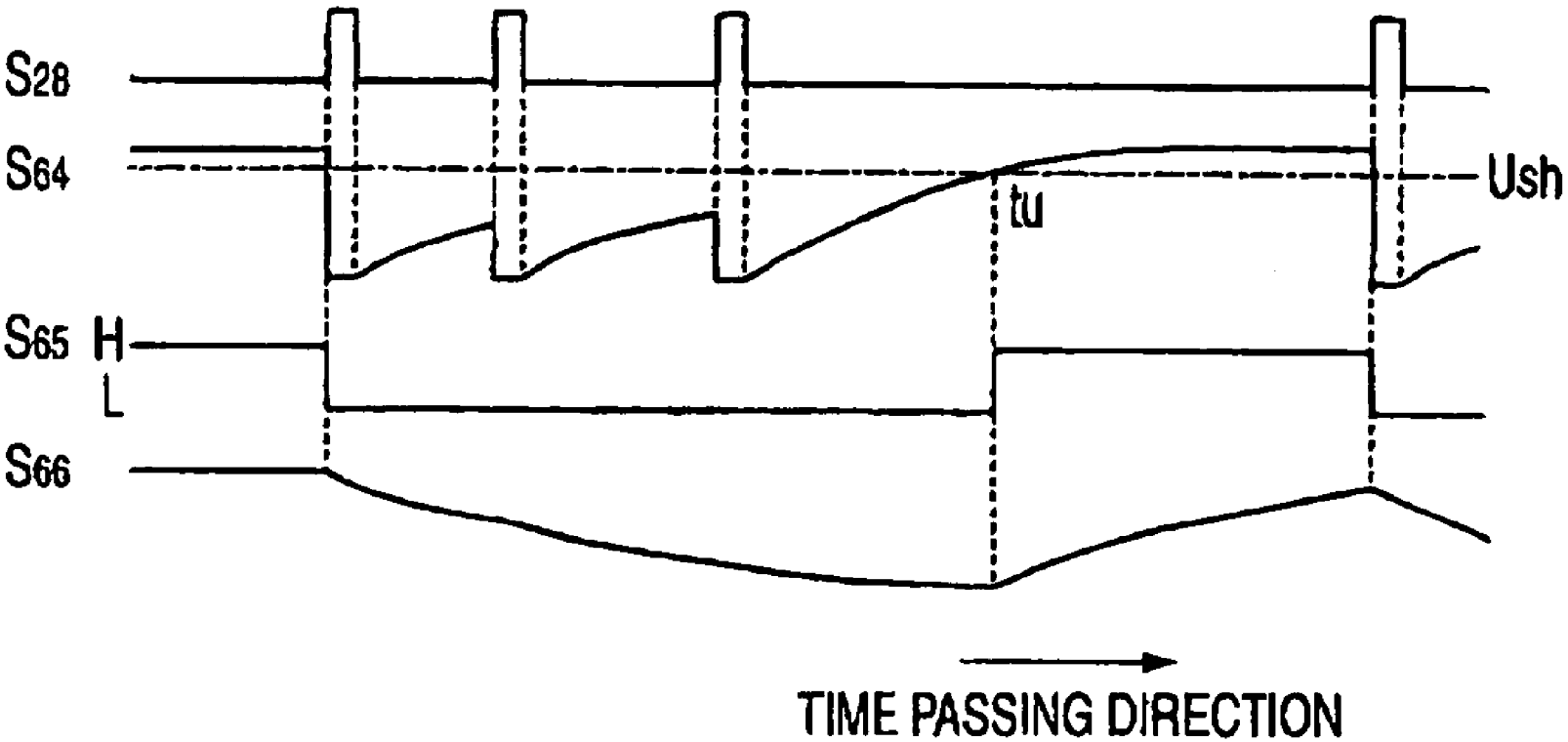
FIG. 13 is a view for explaining about a circuit operation of FIG. 13.

FIG. 13 is a wave form of each section in the circuit section 63. The meaning of each sign is as described below.

"S64"=output voltage of the low pass filter 64

"S65"=output signal (Q-bar output) of the RS flip-flop

"S66"=output voltage of the low pass filter 66 S28 is as described above.

When the RS flip-flop 65 is set in response to the driving situation detection signal S28 and the signal S65 reaches an L level, the capacitor 73 of the low pass filter 66 is discharged with a time constant determined by the electric capacitance of the capacitor and a resistance value of the resistor 72. Voltage reduction of S66 increases the reference current of the current source 33 through the buffer amplifier 74, and a charging current to the capacitor 40 increases, and frequency of a ramp wave, consequently, PFM output frequency goes up.

S64 goes up during a L level period (which shows a pulse interval) in S28, but the capacitor 68 is discharged by a pulse which comes next, and a voltage decreases in each case casein the event that a pulse interval of S28 is long, an output of the RS flip-flop 65 is inverted when (see "tu" of the figure) a level of S64 exceeds a predetermined value (see a threshold value "Ush" of the Schmitt trigger circuit 71), and S65 becomes an H level from an L level.

During the period before a next pulse of S28 comes, S65 is at an H level, and S66 goes up gradually. In sum, this voltage rise depresses a reference current of the current source 33 through the buffer amplifier 74, and a charging current to the capacitor 40 decreases, and frequency of a ramp wave, consequently, PFM output frequency goes down.

As discussed above, in the capacitive domain less than resonance frequency, the drive frequency goes up with a time constant of the low pass filter 66, and a pulse interval of S28 becomes longer little by little. Then, S66 goes up, and the drive frequency goes down gradually. Then, when the drive frequency goes down too much, a driving situation in the capacitive domain is detected, and a pulse interval of S28 becomes short, and is shifted to control of heightening drive frequency.

By repeated performing those operations, the drive frequency becomes settled in the vicinity of the resonance frequency. In sum, when it is detected that the switching element is driven in a frequency range lower than the resonance frequency which is established as a minimum frequency, the driving frequency of the element is raised in accordance with a predetermined time constant. When drive control of the element is carried out in a frequency range higher than the resonance frequency, the drive frequency of the element goes down in accordance with the predetermined time constant.

In this example, stability of frequency control is guaranteed by using the low pass filter 66. In sum, if the drive frequency increases suddenly when a driving situation in the capacitive domain is detected, the following situation occurs: That is, it is returned to a driving situation in the capacitive domain, if control for depressing drive frequency is carried out when it is detected that it has gotten out of the driving situation. Thus, a kind of oscillating situation (or hunting) occurs. To suppress such situations, a response of a frequency control system is made dull by setting the time constant of the low pass filter 66, and thereby, it is possible to obtain stability. However, depending on a setting value of the cutoff frequency of the low pass filter 66, a problem may occur in that its primary role is not played, and in addition, the amount of light of the discharge lamp is changed. That situation becomes noticeable. To prevent occurrence of such a situation it is preferable to set the cutoff frequency of the low pass filter 66 to 200 Hz or more.

According to the above-explained configuration, various advantages may be present in some implementations and are explained below.

Control of the lower limit of the drive frequency of the switching element is provided. In the event that the discharge lamp is lighted, decreasing the drive frequency and increasing the output electric power, or increasing the drive frequency and decreasing the output electric power makes it possible to prevent occurrence of fade-away of the discharge lamp.

If the discharge lamp is lighted, in a driving situation in a frequency range less than the resonance frequency, when it is attempted to depress drive frequency because of shortage of electric power, electric power is depressed much more. As a result, fade-away of the discharge lamp occurs. That is, it is not possible to apply driving control in a frequency range higher than the resonance frequency, to driving control in a frequency range less than the resonance frequency. Therefore, frequency control, which is tuned with a characteristic of each frequency domain, becomes necessary (i.e., in a capacitive domain of less than resonance frequency, control of increasing applied electric power by increasing drive frequency, or of decreasing applied electric power by decreasing drive frequency, is carried out.). However, in such a mode, the circuit configuration and control method become complex. By adopting the above-mentioned configuration, it is possible to carry out consistent control of decreasing drive frequency and increasing output electric power (or, increasing drive frequency and decreasing output electric power) when a discharge lamp is lighted.

By automatically implementing lower limit restriction of the drive frequency in a feedback loop, it is effective for compensating for variation and a moment-to-moment changes of circuit components, and can provide a response to surrounding environment changes.

Resonance frequency does not become constant because of variation in the components used and variations in production. Therefore, when design margins of each component are large, it needs to increase the cost of component, as well as the size of the circuit device. In addition, in case of individual countermeasure of investigating a circuit characteristic after production and storing resonance condition in a control circuit, production cost increases occur. In addition, it is not possible to respond to an instantaneous change and a change of use conditions. Thus, it is possible to detect whether or not driving of the switching element is carried out in a frequency range lower than the resonance frequency, even if the resonance frequency has changed. (In sum, it detects whether the frequency is relatively high or low by using resonance as a benchmark without actually detecting the resonance frequency itself.)

Minimum drive frequency is set to be at or near the resonance frequency. Thus, it is possible to obtain maximum capacity of the lighting circuit.

In a resonance curved line at the time of lighting-up, a control characteristic of frequency-to-electric power is inverted around the resonance frequency as a cross border (see FIG. 2) and, therefore, it is possible to carry out an operation by setting a lower limit value of the drive frequency at or near the resonance frequency. In addition, if the input power supply voltage to the lighting circuit decreases, and if that the maximum electric power has been applied immediately after start-up of the discharge lamp, it is possible to carry out open-loop control with the lower frequency, as compared to frequency in a steady state. Thus, it is effective for simplifying and making a smaller control circuit at low cost.

The driving control, which follows the resonance frequency that changes from hour to hour immediately after start-up of a discharge lamp, can improve the lighting starting property of the discharge lamp.

In a discharge lamp, impedance changes from several kilo Ω up to approximately 10 Ω, for several seconds immediately after its starting. Inductance of a series resonance circuit becomes, for example, composite inductance of a resonance coil and a primary winding of a transformer. An impedance change of the discharge lamp immediately after start-up appears as an inductance change of the resonance circuit.

Figure 14:
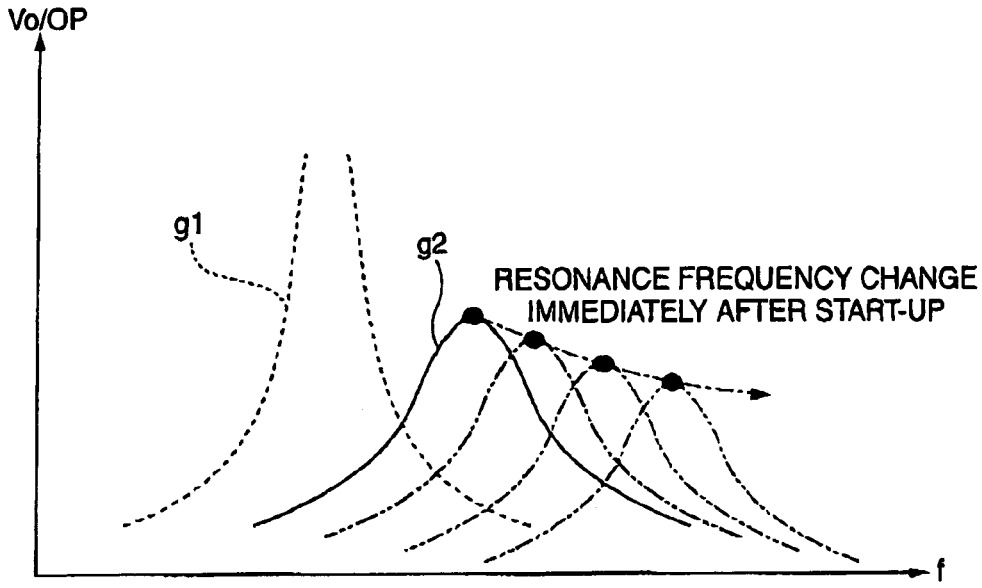
FIG. 14 is a schematic view which shows changes of resonance curved lines and resonance frequency immediately after start-up of a discharge lamp.

FIG. 14 schematically shows changes of resonance curved lines and resonance frequency immediately after start-up. The peak of resonance curved line g2 decreases gradually as the frequency f increases.

At a short time after the discharge lamp is started (e.g., after about 1 second), it is desirable to urge growth of the discharge arc by applying the maximum electric power permissible in the lighting circuit of the discharge lamp. If driving control with resonance frequency, which changes over time, is carried out, it is possible to obtain peak electric power in the resonance curved line. In sum, if the lower limit of the drive frequency is set to the resonance frequency, it is preferable to follow the resonance point so as to be able to obtain a driving situation at or near resonance immediately after start-up.

A phase difference between a detection signal relating to a driving signal (Sdrv) for a switching element (or a detection signal relating to an output of a DC-AC conversion circuit which is equivalent to the signal) or a detection signal of a lamp voltage (VL), and a detection signal of a lamp current (IL) of a discharge lamp is detected. With this phase difference, it is judged whether or not driving control of a switching element is carried out in lower frequency than a frequency domain of a resonance situation or the vicinity of the resonance situation, and it is possible to detect a level of deviation from the resonance situation.

A method of investigating whether or not an output to a discharge lamp has reached its maximum driving frequency is cited as an example of a judgment method regarding a driving situation in a resonance situation. In such a case, it is necessary to investigate a change of output electric power over intentionally changing frequency and, therefore, it cannot be adopted in a lighting-up situation of a discharge lamp (since it is accompanied by a light quantity change).

A method of investigating deviation from the resonance situation by detecting a phase difference between respective signals as described above, is desirable. For example, a current detection resistor can be connected in series with a discharge lamp, and a lamp current can be detected by using ground electric potential as a benchmark. For electric power control of a discharge lamp, use of a detection signal of a lamp current can be used and, therefore, it is possible to use the detection signal also for that purpose.

From an aspect of accuracy guarantee, as a signal which compared with regard to a phase relation with a detection signal of a lamp current, it is preferable to use a detection signal relating to the above-described signal Sdrv or a detection signal relating to an output of a DC-AC conversion circuit which is equivalent to the signal Sdrv, rather than a detection signal of a lamp voltage. (Lamp voltage wave form VL of a discharge lamp becomes a distorted sine wave since a re-firing voltage of a bridge at the time of polarity changeover is overlapped with it as described above. Therefore, by using a stable wave form like Sdrv, it is possible to carry out phase detection with higher accuracy.).

In the above-mentioned mode (A), in case of having detected a driving situation in a lower frequency domain than resonance frequency, a phase of a bridge driving signal is compulsorily inverted, and thereby, it is possible to effect lower limit restriction of frequency more preferentially and surely than in electric power control (feedback control) of a discharge lamp.

In the above-mentioned mode (B), if a driving situation is detected in a frequency range lower than the resonance frequency, it is possible to operate a control target of applied electric power, depending on the amount of deviation from the resonance situation, and it is possible to control the drive frequency on the basis of a driving situation detection signal.

If a driving situation is detected in a frequency range lower than the resonance frequency, it is desirable to gradually increase the drive frequency in accordance with predetermined a time constant, to guarantee stable driving control.

What is claimed is:

1. A discharge lamp lighting circuit comprising a discharge lamp, a DC-AC conversion circuit having a plurality of switching elements and a series resonance circuit, and a control circuit for preventing continuation of a situation in which a drive frequency of the switching element is less than its specified minimum frequency, wherein the control circuit comprises a driving situation detection circuit for detecting the phase difference between a signal for driving the switching element, the output of the DC-AC conversion circuit or a signal that corresponds to the voltage of the discharge lamp and a signal that corresponds to the current of the discharge lamp;

wherein when the discharge lamp is lit, the switching element is driven at a frequency in a frequency range which is higher than a resonant frequency of the series resonance circuit, and a driving situation of the switching element is monitored by the driving situation detection circuit, and wherein, upon detection that the phase of the signal that corresponds to the current of the discharge lamp is leading the phase of any of the signal for driving the switching element, the output of the DC-AC conversion circuit or a signal that corresponds to the voltage of the discharge lamp, the drive frequency is increased.

2. The discharge lamp lighting circuit of claim 1, wherein the specified minimum frequency is set at or near the resonant frequency of the series resonance circuit.

3. The discharge lamp lighting circuit of claim 2, wherein, if it is detected that the switching element is driven in a frequency range lower than the specified minimum frequency, polarity of a signal for driving the switching element is inverted.

4. The discharge lamp lighting circuit of claim 2, wherein if it is detected that the switching element is driven in a frequency range lower than the specified minimum frequency, a target value of electric power applied to the discharge lamp is reduced depending on an amount of deviation from the specified minimum frequency.

5. The discharge lamp lighting circuit of claim 2, wherein if it is detected that the switching element is driven in a frequency range lower than the specified minimum frequency, the drive frequency of the switching element is raised in accordance with a predetermined time constant.

6. The discharge lamp lighting circuit of claim 2 wherein the driving situation detection circuit is configured to determine an amount of deviation from resonance.

7. The discharge lamp lighting circuit of claim 1 wherein the driving situation detection circuit is configured to determine an amount of deviation from resonance.

8. The discharge lamp lighting circuit of claim 1, wherein, if it is detected that the switching element is driven in a frequency range lower than the specified minimum frequency, polarity of a signal for driving the switching element is inverted.

9. The discharge lamp lighting circuit of claim 1, wherein if it is detected that the switching element is driven in a frequency range lower than the specified minimum frequency, a target value of electric power applied to the discharge lamp is reduced depending on an amount of deviation from the specified minimum frequency.

10. The discharge lamp lighting circuit of claim 1, wherein if it is detected that the switching element is driven in a frequency range lower than the specified minimum frequency, the drive frequency of the switching element is raised in accordance with a predetermined time constant.

* * * * *